US008033495B2

(12) United States Patent
Andersson et al.

(10) Patent No.: US 8,033,495 B2
(45) Date of Patent: Oct. 11, 2011

(54) FLYING PASTER ARRANGEMENT

(75) Inventors: Marcus Andersson, Dals Rostock (SE); Hans Hogberg, Amal (SE)

(73) Assignee: MegTec Systems Amal Aktiebolag, Amal (SE)

( * ) Notice: Subject to any disclaimer, the term of this patent is extended or adjusted under 35 U.S.C. 154(b) by 105 days.

(21) Appl. No.: 12/309,065

(22) PCT Filed: Jun. 19, 2007

(86) PCT No.: PCT/SE2007/050433

§ 371 (c)(1),
(2), (4) Date: Mar. 6, 2009

(87) PCT Pub. No.: WO2008/008026

PCT Pub. Date: Jan. 17, 2008

(65) Prior Publication Data

US 2010/0237181 A1 Sep. 23, 2010

(30) Foreign Application Priority Data

Jul. 10, 2006 (SE) ..... 0601534

(51) Int. Cl.
*B65H 19/18* (2006.01)

(52) U.S. Cl. ..... 242/555; 242/555.1; 242/555.5; 242/599.1

(58) Field of Classification Search ..... 242/555, 242/555.1–555.5, 578, 599.1
See application file for complete search history.

(56) References Cited

U.S. PATENT DOCUMENTS 1,550,315 A * 8/1925 Hammer ..... 242/555.5
3,055,337 A 9/1962 Cossaboon
3,207,452 A 9/1965 Haskin et al. ..... 242/533.4
(Continued)

FOREIGN PATENT DOCUMENTS

FR 1 105 901 A 12/1955
(Continued)

OTHER PUBLICATIONS

The International Search Report dated Oct. 2, 2007.
(Continued)

*Primary Examiner* — Sang Kim
(74) *Attorney, Agent, or Firm* — Nields, Lemack & Frame, LLC

(57) ABSTRACT

This invention relates to flying paster, comprising a frame (1), a turret (46) rotatably arranged around a horizontal axis (L1) inside of said frame (1), reel arms (3, 5; 3A, 3B, 5A, 5B) arranged on said turret (46), at least one of said reel arms (3, 5; 3A, 3B, 5A, 5B) arranged to be axially movable on said turret (46), said moveable reel arm (3; 3A, 5 5B) holding at least one chuck arrangement (30A, 30B; 50B) for paper rolls (R1, R2; R1', R2'), said at least one chuck arrangement (30A, 30B; 50B) having a driven spindle (328, 329) to drive at least one of said paper rolls (R1, R2; R1', R2) and at least one motor (20; 20A, 20B) which via at least one transmission arrangement (21-27) is arranged to drive said spindle (328, 329), wherein that said at least one motor (20; 20A, 10 20B) is arranged outside of said frame (1) and that said transmission arrangement (21-27) is arranged to transmit the driving force to said spindle (328, 329) by means of a coaxially extending device that extends coaxially with said horizontal axis (L1).

10 Claims, 6 Drawing Sheets

U.S. PATENT DOCUMENTS

| | | | | |
|---|---|---|---|---|
| 3,460,775 | A | 8/1969 | Ford et al. | 242/555.6 |
| 3,635,415 | A * | 1/1972 | Phelps et al. | 242/533.6 |
| 3,892,012 | A * | 7/1975 | Keferstein | 242/527.3 |
| 5,334,870 | A | 8/1994 | Katada et al. | 257/371 |
| 5,335,870 | A | 8/1994 | Martin | |
| 5,445,341 | A | 8/1995 | Martin et al. | 242/527.3 |
| 6,616,086 | B2 | 9/2003 | Nakamura et al. | 242/559.2 |

FOREIGN PATENT DOCUMENTS

| | | | |
|---|---|---|---|
| GB | 439 362 | A | 12/1935 |

OTHER PUBLICATIONS

European communication dated Nov. 16, 2010 in a corresponding foreign application (EP07748593.6).

* cited by examiner

FLYING PASTER ARRANGEMENT

TECHNICAL FIELD

This invention relates to flying paster, comprising a frame, a turret rotatably arranged around a horizontal axis inside of said frame, reel arms arranged on said turret, at least one of said reel arms arranged to be axially movable on said turret, said reel arms holding chuck arrangements for paper rolls, two of said chucks arrangements having driven spindles to drive each one of said paper rolls and at least one motor which via at least one transmission arrangement is arranged to drive said spindles.

PRIOR ART

Flying pasters are highly developed machines used in the printing industry to enable continuous operation, e.g. change of printing rolls. Modern flying paster design includes two arms, e.g. independent drive and core tension control. Today the most advanced model features 4-quadrant drive and breaking, e.g. to provide optimum web tension. The results of fewer web brakes, simplest splices preparation and low maintenance.

However, this development has also implied increased costs, since it implies complex and individual design of almost every machine that is to be produced. By way of example it may be referred to flying pasters technology referred to in U.S. Pat. Nos. 5,335,870 and 5,445,341.

SUMMARY OF THE INVENTION

It is an object of the invention to eliminate or at least minimize the above disadvantage, which is achieved by means of the flying paster, comprising a frame, a turret rotatably arranged around a horizontal axis inside of said frame, reel arms arranged on said turret, at least one of said reel arms arranged to be axially movable on said turret, said reel arms holding chuck arrangements for paper rolls, two of said chucks arrangements having driven spindles to drive each one of said paper rolls and at least one motor which via at least one transmission arrangement is arranged to drive said spindles, wherein that said at least one motor is arranged outside of said frame and that said transmission arrangement is arranged to transmit the driving force to said spindles by means of coaxially extending device that extends coaxially with said horizontal axis.

Thanks to an arrangement according to the invention there is provided a basis for having a modularised concept for the drive independent of size and type of flying paster.

Hence, it facilitates the use of the same basic design principles within differently sized and equipped flying pasters. As a consequence a considerable lower cost may be achieved. Moreover it also provides for machines having higher reliability thanks to a reduced variety of parts.

Further aspects of the invention will become apparent in the following description.

BRIEF DESCRIPTION OF THE DRAWINGS

In the following the invention will be described in more detail with reference to preferred embodiments shown in the enclosed drawings, wherein.

DETAILED DESCRIPTION

Figure 1:
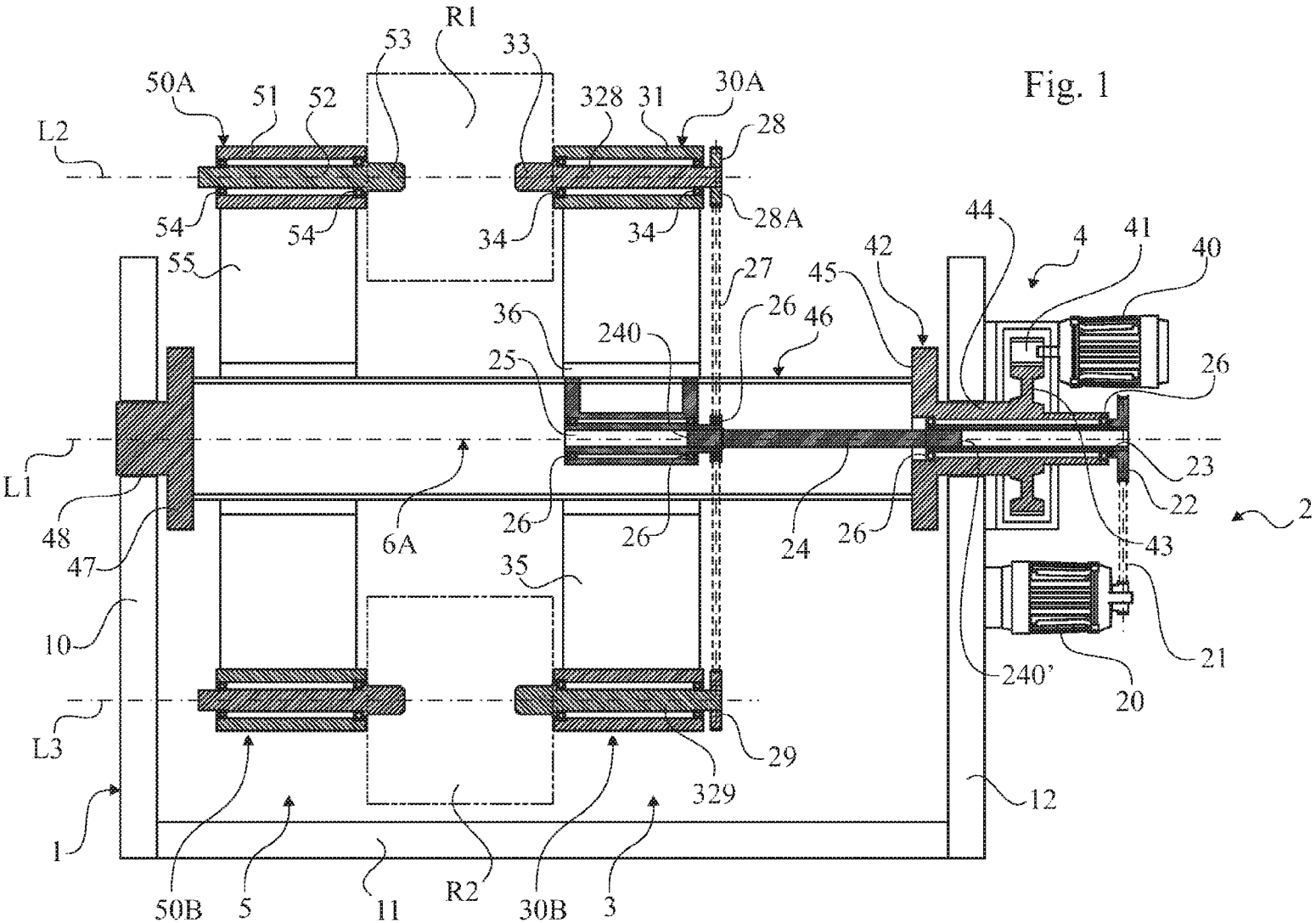
FIG. 1 is partly schematic cross sectional, a vertical front view of a flying paster according to the invention, using straight arms.

In FIG. 1 there is shown a schematic cross sectional front view of flying paster according to the invention. The flying paster shown in FIG. 1 is of the kind having straight reel arms 3, 5. The reel arms 3, 5 are axially moveably arranged on a turret 46, which is rotatably arranged within support around a central horizontal axis L1 frame 1. The frame 1 comprises a left hand side wall 10, a right hand side wall 12 and an intermediate base portion 11. The turret 46 comprises endplates 45, 47 connected to hub portions 44, 48. The hub portions 44, 48 are immovable axially but rotatably arranged to one side each 10, 12 of the frame, by means of bearings (not shown), to allow the turret 46 to rotate without any axial movement. The right hand side of the turret 46 is connected to a motor 40 and a transmission 41, 42 to control the rotation of the turret 46. The motor 40 is attached to the frame 1. The motor 40 drives a dented driven wheel 41, which is in contact with a correspondingly dented driven wheel 43 fixedly attached to the driven turret hub 44. Hence the part of the transmission 42 that is fixed to the turret 46 includes a dented wheel 43 arranged on the outer side of the right hand wall 12 and at the other side of the hub 44, i.e. the inside of the wall 12 an endplate 45. Accordingly the rotation transmitting portion 42 for the turret comprises and endplate 45 attached to the turret, positioned within said frame 1 and a hub portion 44 that extends through the side wall 12 to the driven wheel 43. Further it is shown that the hub portion 44 protrudes beyond the annular portion with the driven wheel 43. Adjacent the outer end of the protruding hub 44, and also adjacent the inner end, there are arranged bearings 26. The inner annular portion of these bearings 26 support a first portion 23 of a shaft 23, 24, 25.

The shaft 23, 24, 25 is telescopically arranged by means of splines. The splines will allow the intermediate shaft portion 24 to be axially moveable within a hollow centre portion of an outer shaft 23 and also within a hollow centre portion of an inner shaft 25. Adjacent the outer end of the outer shaft 23, there is fixedly attached a dented wheel 22. The dented wheel 22 is powered via a dented belt 21 by means of a motor 20 that is fixedly attached to a attachment base 12A at the outer side of the side wall 12 of the frame 1, in a position to not interfere with the other motor 40 (e.g. diametrically) and preferably at a distant that is about 200-1000 mm, preferably 300-700 mm from the centre line L1 to allow for sufficient space to allow for varying kind and size of motors to be attached at the same location 12A. The intermediate shaft 24 is arranged with splines along its outer surface and the inner shaft 23 and outer shaft 25 respectively are arranged with corresponding splines at their inner surfaces, to allow transmission of torque from the motor 20, via belt 21, via dented wheel 22, via outer shaft 23, via intermediate shaft 24, to outer shaft 25. Adjacent the outer end of the inner shaft 25 there is fixedly attached a dented chain wheel 26. The dented chain wheel drives an endless chain 27, which in turn drives a first driven chain wheel 28 and a second driven chain wheel 29. Each one of said driven chain wheels 28, 29 are arranged in connection with a first 30A and a second 30B chuck arrangement on the reel arm arranged closest to the right hand side wall 12. A corresponding chuck arrangement 50A, 50B is arranged on the second arm 5 on the other side of the turret 46. The chuck arrangements 30A, 30B, 50B, 50A are provided for holding a first roll R1 and a second roll R2 respectively. A first 33 and a third chuck 53 hold the first roll R1 and a corresponding second and fourth chuck hold the second roll R2. In the following merely the upper pair of chuck arrangements 30A, 50A will be described in more detail since the other pair is arranged in exactly the same manner.

The driven wheel 28 is connected on to the outer end of a spindle 328. In between the spindle 328 and the driven wheel 28 there is a free wheel hub 28A. The chuck arrangement 30A, 50A comprise a casing 31, 51 arranged with bearings 34, 54 to allow the spindles 328, 52 to freely rotate within the housings 31, 51. The chuck arrangements 30A, 50A also include gripping mechanisms (not shown), which allow the chucks 33, 53 to safely grip into the hollow core of the roll R1 and also to release the core (as is known per se).

Figure 2:
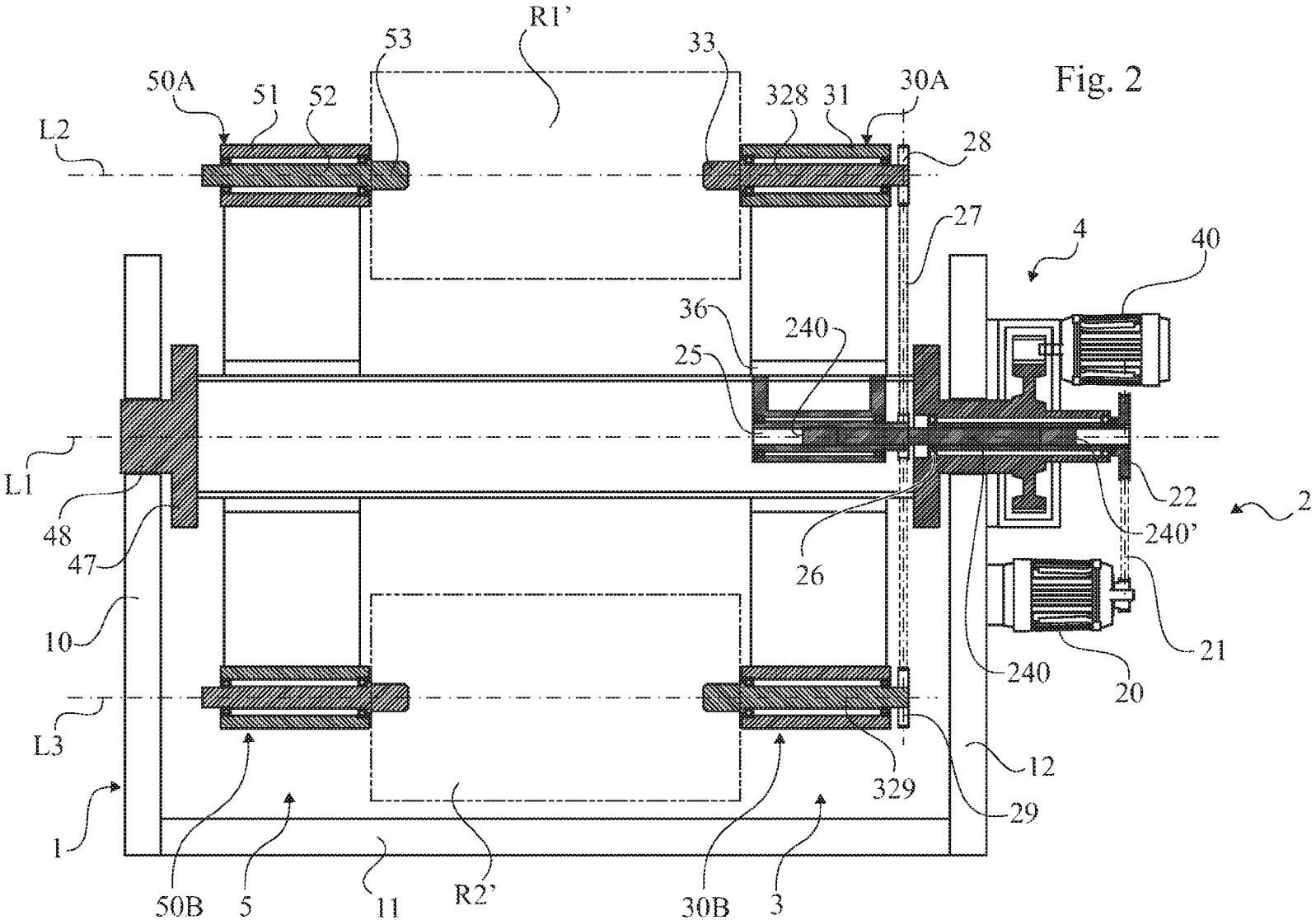
FIG. 2 shows the same flying paster and view as FIG. 1, but in a different operating position.

In FIG. 2 there is shown that the first reel arm 3 has been moved to an other position compared to FIG. 1. By moving the first arm 3 into this second position rolls R1', R2' of different size can be arranged within the flying paster. As can be seen in FIG. 2 the intermediate shaft 24 telescopically moves into both the outer shaft 25 and the inner shaft 23, whereby the end portions 240, 240' of the intermediate shaft 24 will be positioned adjacent central portion of each one of the inner shaft 23 and the outer shaft 25 respectively. The other parts of the transmission will maintain their respective positions in relation to the part to which they are connected.

Figure 3:
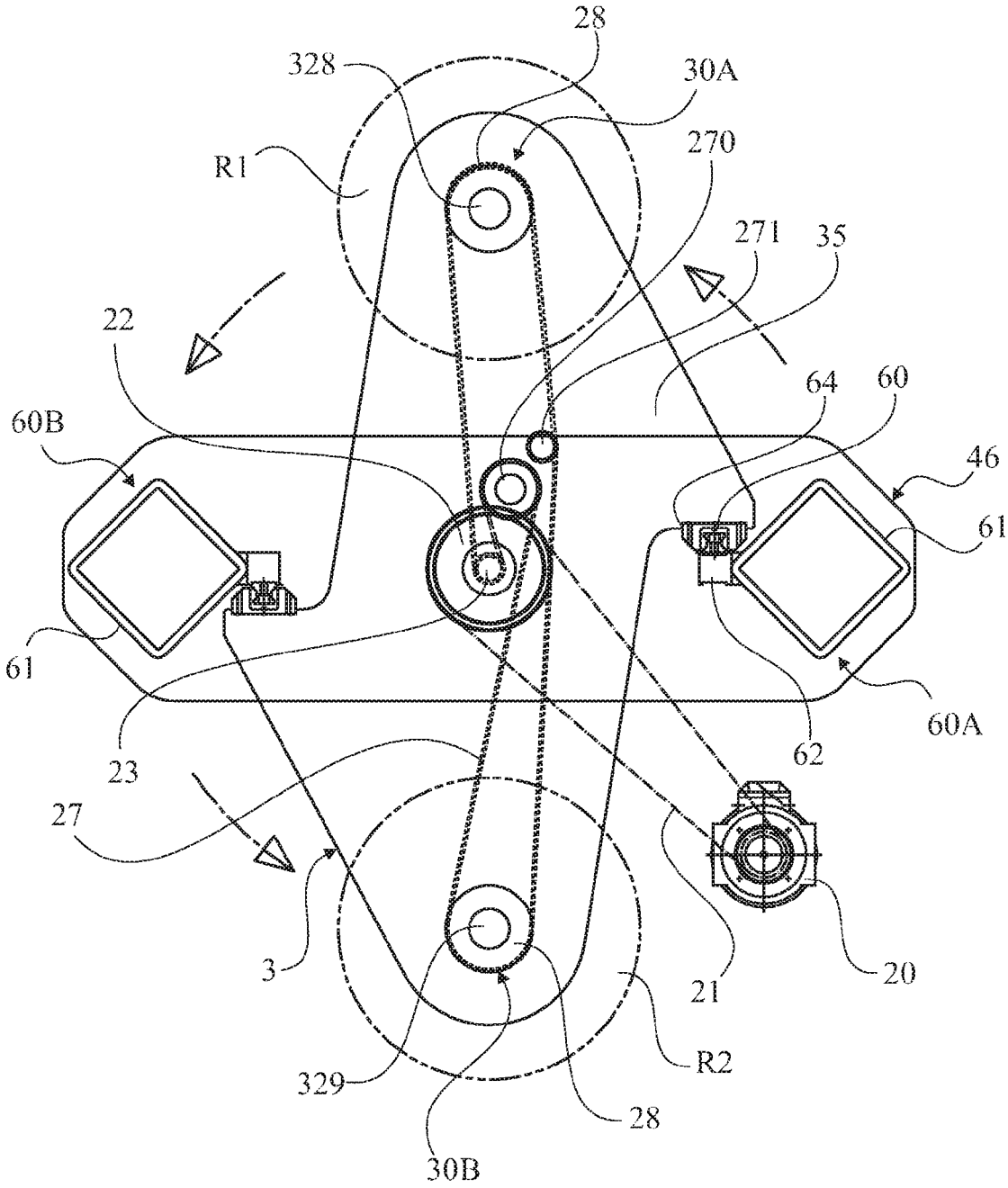
FIG. 3 is a schematic side view of the flying paster shown in FIGS. 1 and 2.

In FIG. 3 there is shown a schematic side view of the flying paster of FIGS. 1 and 2. Here it is clearly shown that in a preferred embodiment one endless chain 27 is used to transmit the torque from the driving chain wheel 23 to the driven chain wheels 28, 29. Further it is shown that the reel arm 3 comprises a support structure 35 for fixing the chuck arrangements 30A, 30B at preferred distances (normally between 500-1000 m, preferably half the diameter of the roll R+clearing distance) away from the horizontal centre line L1 of the paster. The support structure 35 is axially moveable in relation to the turret 46. The turret 46 for this purpose includes horizontal beams 61 carrying horizontal guiding bars 62 at the side of the beam 61 that face inwardly. Said guide bar 62 carries a rail/bearing arrangement 60 that is interconnected with a corresponding guide mechanism 64 that is fixedly attached to the support structure 35 of the reel arm 3. Accordingly the support structure 35 of the reel arm may be axially moved by means of said axial rail/bearing arrangement 62, 60, 64 (as is known per se). By means of activating the motor 40 that can turn the turret 46 the whole turret and reel arm arrangement 3 may be rotated around the horizontal centre line L1 as indicated by the arrows in FIG. 3.

The function of the flying paster presented in FIGS. 1-3 is as follows. Due to the fact that straight reel arms 3, 5 are being used the same width of the rolls R1, R2 has to be used. Assuming that the upper roll R1 is being unwound, that process will continue until that roll R1 is close to being empty. In conjunction therewith the turret 46 will be rotated by means of the motor 40 and the corresponding transmission 41, 42, to move the full roll R2 into the splicing position. Simultaneously that full roll R2 will be accelerated by means of motor 20 and the corresponding transmission 21-29 to obtain a synchronous speed in relation to the web that is being unwound. Thanks to the free wheel hub 28 the spindle 328 of the chuck arrangement 30A that is connected to the first roll R1 will be free wheeling, since the smaller diameter of the first roll R1 will require a much higher rotational speed than that of the larger roll R2. Once the second roll R2 has been spliced in (known per se) and the turret 46 again rotated, the remaining core of the first roll R1 may be removed by collapsing the chucks 33, 53 and removing the spindles 52, 328 out of position (i.e. displaceable chucks) from the centre core of the emptied roll R1. Thereafter a new roll may be put into position and the process may be continued without any interruption being necessary.

As is understood from the figures, the mere difference between FIGS. 1 and 2 is that the first reel arm 3 is positioned at different locations, but thanks to the telescoping intermediate shaft 24 no other changes are necessary.

Figure 4:
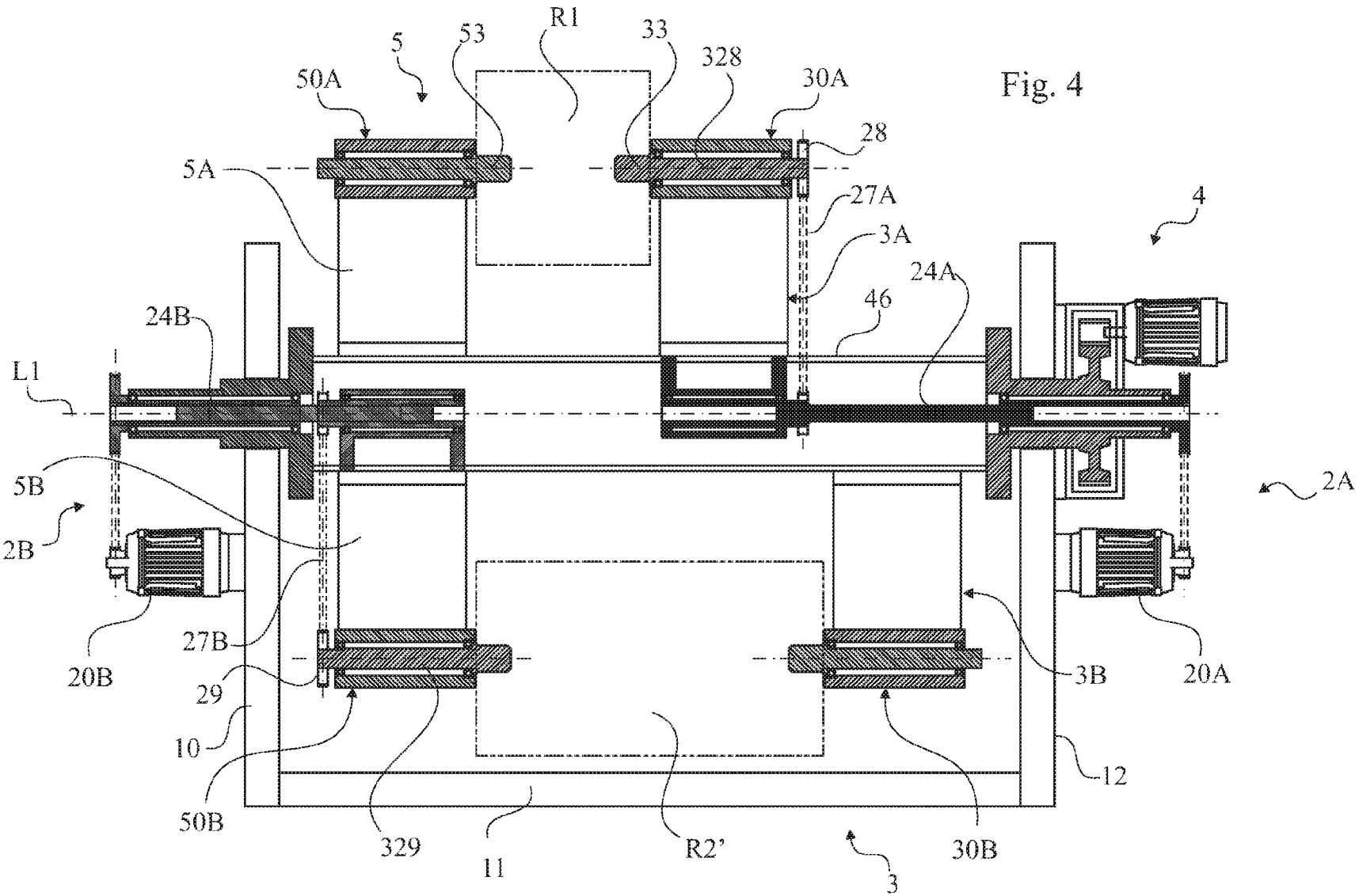
FIG. 4 shows a cross sectional vertical front view of a flying paster according to the invention using split arms.
Figure 5:
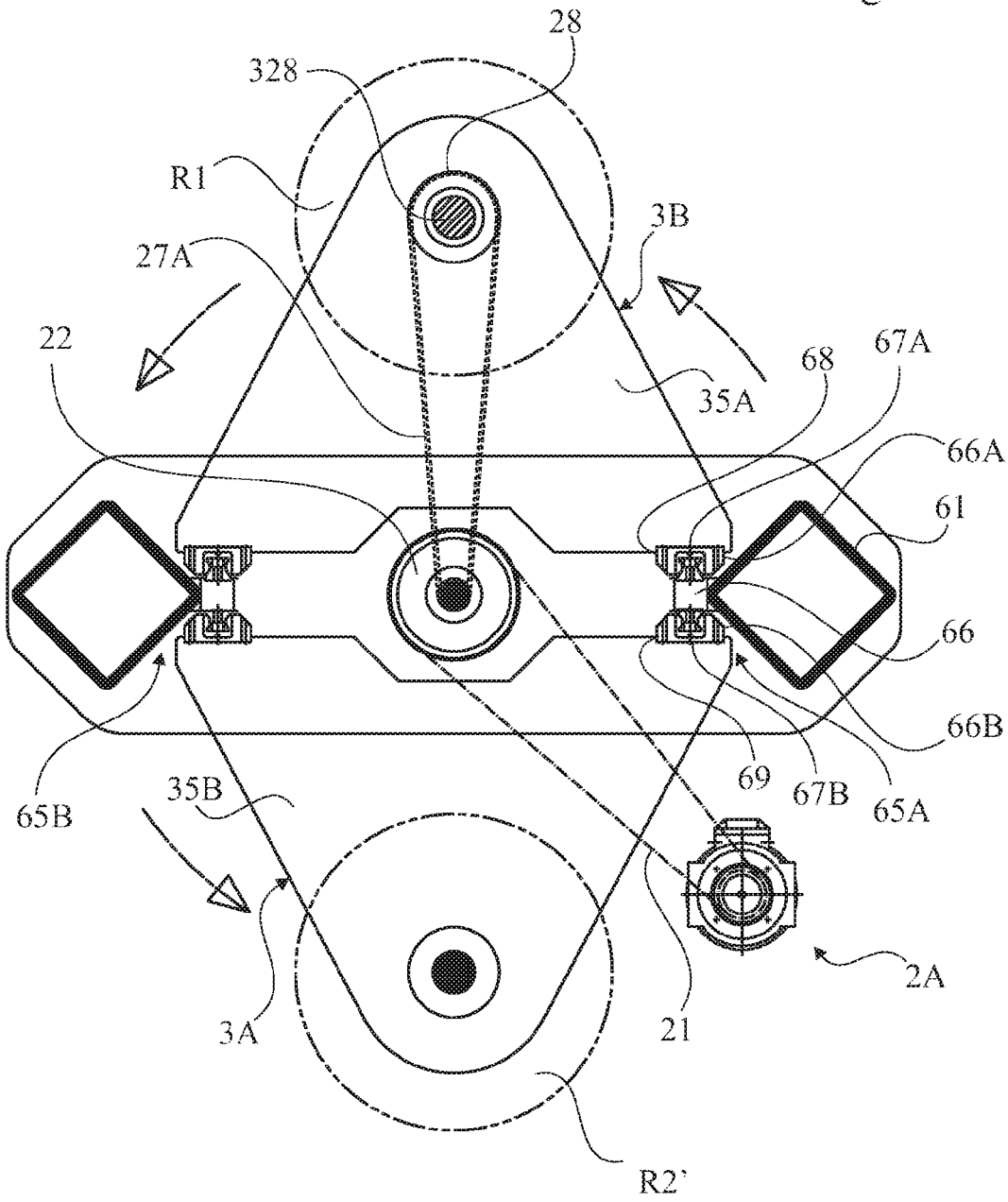
FIG. 5 shows a schematic side view of the flying paster shown in FIG. 4.
Figure 6:
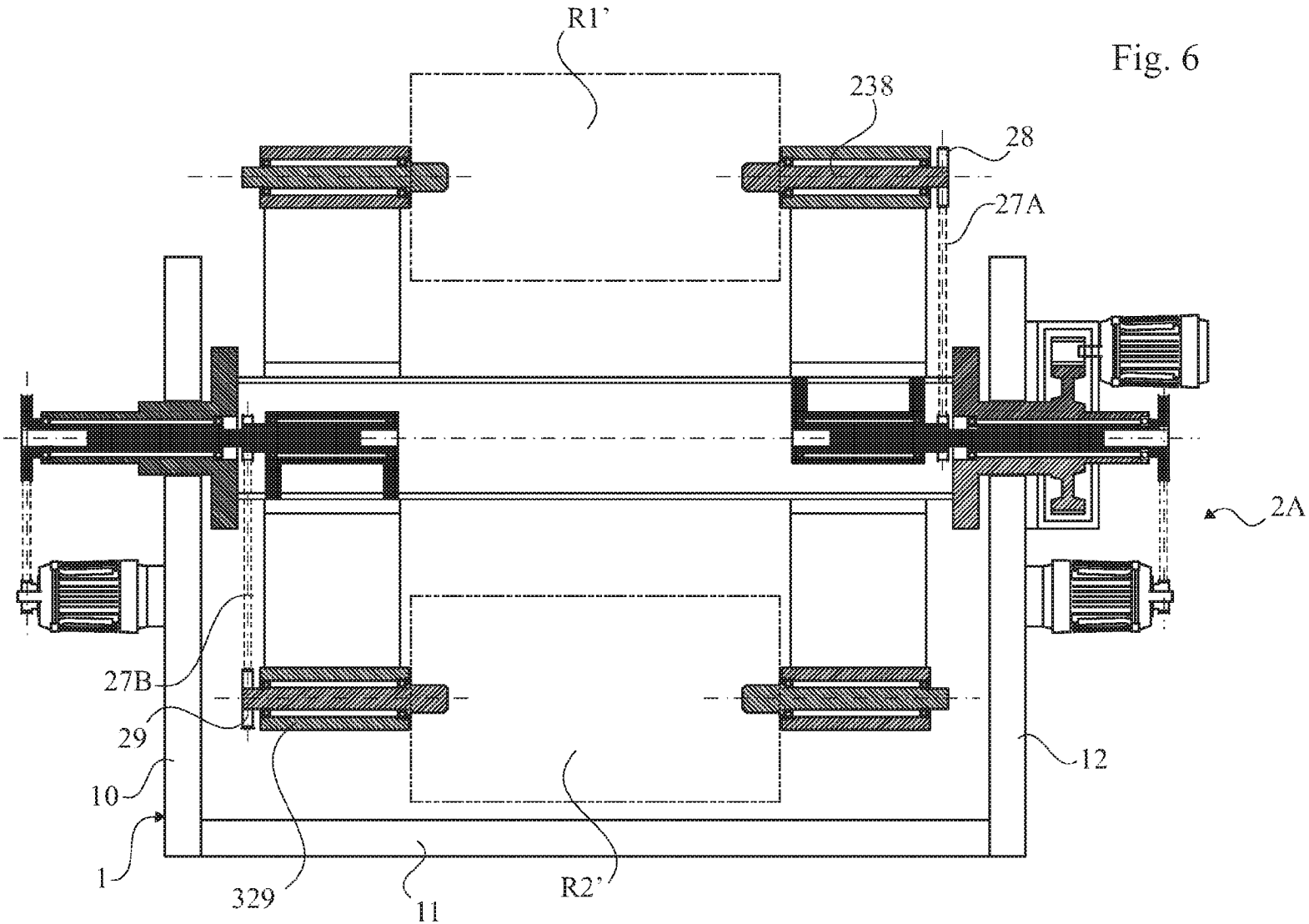
FIG. 6 shows the flying paster of FIGS. 4 and 5 in a different operating position.

In FIGS. 4, 5 and 6 there is shown a second embodiment according to the invention, where split arms 3A, 3B, 5A, 5B are being used instead of straight arms as presented in FIGS. 1-3. As is evident from FIGS. 4-6 exactly the same principles for driving the spindles 328, 329 is used as in accordance with FIGS. 1-3. A major difference for the split arm concept is that two drives and consequently two motors 20A, 20B are needed. One motor 20A for driving one spindle 328 on the right hand side and a second motor 20B for driving the other spindle 329, on the left hand side. In other aspects the drive and transmission for each one of the spindles 328, 329 and also the turret 46 is the same. Accordingly the description above in relation to FIGS. 1-3 for most of the features is also relevant in relation to FIGS. 4-6, which is also indicated by using the same or at least similar reference numerals for corresponding parts. As already mentioned an important difference is that there is both a right hand drive 2A and a left hand drive 2B for driving each one of the spindles 328, 329. It should be noted that the driven spindles 328, 329 are positioned on opposite sides of the centre line L1 of the flying paster. By having the driven spindles position in this manner each one of the spindles 328, 329 may be independently driven to independently control the speed of a first 121 and a second roll R2'. As a consequence of the split arm arrangements the first roll R1 and the second roll R2' may have different widths. In the shown example the upper roll R1 has about half of the width of the second roll R2'. This is achieved by positioning both of the split arms 5A, 5B of the left hand reel arm 5 in equal axial positions, but the split arms 3A, 3B of the other reel arm 3 in different positions. Here the upper split arm 3A is positioned at its innermost position, i.e. adjacent the middle of the turret 46, whereas the other split arm 3B of the first reel arm 3 is positioned at its outermost position, i.e. adjacent the right hand side wall 12. Hence the motor 20A on the right hand, attached to the outer side of the right hand side wall 12 of the frame 1, drives the upper roll R1 by means of the spindle 328 via its transmission, that in basic principles corresponds exactly to the transmission presented in FIGS. 1-3, except for the drive chain 27A merely being connected to one drive wheel 28 of that spindle 328. In a corresponding manner the split arm 5B that holds the other spindle 329, is driven by the same kind of transmission, e.g. including its drive chain 27B also merely extending between one driving chain wheel to one driven chain wheel 29. A further difference in relation to the straight arm concept is that there is no absolute need for using free wheel hubs since there is one motor for each one of the rolls R1, R2'.

In FIG. 5 there is shown a side view of the split arm concept of FIG. 4, wherein the drive 4A for the upper roll R1 is shown, clearly presenting that the drive chain 27A merely runs around the driving wheel 26A and the driven chain wheel 28. Moreover FIG. 5 presents that the split arm concept requires a modified attachment of each split arm support 35A, 35B for the attachment to the turret 46. Also here the same kind of beam 61 is being used but each beam 61 will carry a double sided guide bar 66 to enable independent axial movability of each one of the split arms 35A, 35B, 55A, 55B. The guiding mechanism is designed along the same principles as described in relation to FIGS. 1-3, i.e. including a bearing portion 67A, 67B and a corresponding guiding mechanism 68, 69 at the base on each side of the guide arms 35A-55B.

Thanks to the concept according to the invention major advantages may be achieved; e.g.:

- the same design of the reel arms independent of motor size (since the motor is fixed; i.e. does not rotate with the turret),
- the same design of the "drive side" of the frame allowing differently sized motors to be used, etc.,
- modularised design that allows same kind of details/equipment independent of size or type of drives/web tension/connecting equipment,
- big motors are easily mounted/fixed onto the frame,
- much more cost efficient solution thanks to no need for power connectors in slippering units, and less connections needed,
- a fewer number of spare parts, etc.

The invention is not limited by what has been described above but may be varied within the scope defined by the enclosed claims. For instance the skilled person is well aware of the fact that many of the functions used by the invention may be achieved in varying manners. For instance the telescoping function may be achieved by other means than using splines, e.g. different interlocking cross sectional shapes having friction reducing means (e.g. lubrication) in between. Also the force transmission from both the motor to the shaft and from the shaft to the driven wheels may in a corresponding manner be achieved by different known other equivalent means, e.g. dented belts, cog wheel transmissions, etc. Moreover it is understood by the skilled person that the turret arrangement may also be modified within wide limits without departing from the scope of the invention, e.g. using horizontal beams of substantially different cross sectional form than the shown hollow squared, using a different guiding mechanism for allowing the reel arms to be axially adjustable/movable, using motorised or manual power for movement of the reel arms. Further it is understood that the principles of the invention may advantageously be used in connection with any kind of desired drive (i.e. 1 quadrant, 2 quadrant, or 4 quadrant) and also in connection with many different kind of known chuck arrangements, e.g. both fixed chuck spindles and displaceable chuck spindles. Further, it is evident that the single endless chain 27 shown in FIGS. 1-3 may easily be exchanged by two (or more) chains each one driven by its own dented wheel.

The invention claimed is:

1. A flying paster, comprising a frame (1), a turret (46) rotatably arranged around a horizontal axis (L1) inside of said frame (1), reel arms (3, 5; 3A, 3B, 5A, 5B) arranged on said turret (46), at least one of said reel arms (3, 5; 3A, 3B, 5A, 5B) arranged to be axially movable on said turret (46), said moveable reel arm (3; 3A, 5B) holding at least one chuck arrangement (30A, 30B; 50B) for paper rolls (R1, R2; R1', R2'), said at least one chuck arrangement (30A, 30B; 50B) having a driven spindle (328, 329) to drive at least one of said paper rolls (R1, R2; R1', R2') and at least one motor (20; 20A, 20B) which via at least one transmission arrangement (21-27) is arranged to drive said spindle (328, 329), wherein said at least one motor (20; 20A, 20B) is arranged outside of said frame (1) and that said transmission arrangement (21-27) is arranged to transmit the driving force to said spindle (328, 329) by means of a coaxially extending device that extends coaxially with said horizontal axis (L1).

2. The flying paster according to claim 1, wherein said coaxially extending device is in the form of a shaft or shaft arrangement (23, 24).

3. The flying paster according to claim 2, wherein said shaft arrangement (23, 24) comprises a telescopically arranged shaft (24).

4. The flying paster according to claim 3, wherein said telescopically arranged shaft (24) is axially moveable in relation to an outer force transmitting portion (23).

5. The flying paster according to claim 3 or 4, wherein said telescopically arranged shaft (24) is axially moveable in relation to an inner force transmitting portion (25).

6. The flying paster according to any of claim 1, 2, 3 or 4, wherein said at least one motor (20) is arranged to drive both of said spindles (328, 329).

7. The flying paster according to claim 6, wherein said coaxially extending device, rotation wise, is connected to an inner force transmitting wheel (26) that via one or more endless chain/s or belt/s (27) drives both of said spindles (328, 329) and that free wheeling devices (28A, 29A) are arranged to allow merely one of said spindles (328, 329) not to be driven by said motor (20).

8. The flying paster according to any of claims 1, 2, 3 or 4, wherein at least one of said reel arms (3A, 3B, 5A, 5B) is in the form of a split arm comprising a pair of split arms (3A, 3B; 5A, 5B) wherein a first motor (20A) is arranged to drive one of said spindles (328), and a second motor (20B) to drive the other one of said spindles (329).

9. The flying paster according to claim 8, wherein both of said reel arms (3, 5) are in the form of pair of split arms (3A, 3B, 5A, 5B).

10. The flying paster according to claim 8, wherein said spindles (328, 329) are diagonally arranged in relation to each other.

* * * * *